US005213055A

United States Patent [19]

Hofbauer

[11] Patent Number: 5,213,055

[45] Date of Patent: May 25, 1993

[54] TEMPLATE FOR CLEANING OR PAINTING OF A GIMBAL HOUSING

[76] Inventor: Arthur M. Hofbauer, 2931 Whaleneck Dr., Merrick, N.Y. 11566

[21] Appl. No.: 764,414

[22] Filed: Sep. 23, 1991

[51] Int. Cl.[5] ..... B63B 59/00; B63B 9/00; B63B 35/00

[52] U.S. Cl. ..... 114/222; 114/221 R; 114/270; 118/504

[58] Field of Search ..... 114/222, 270, 224, 221 R, 114/361, 201 A; 41/39; 118/504, 326; 134/82, 92, 125, 137, 143, 158, 180, 182, 183, 201

[56] References Cited

U.S. PATENT DOCUMENTS

| | | | |
|---|---|---|---|
| 804,569 | 11/1905 | Watson | 118/504 |
| 1,735,660 | 11/1929 | Svendsen et al. . | |
| 1,843,432 | 2/1932 | Nickerson . | |
| 2,393,668 | 1/1946 | Wartha | 41/39 |
| 2,517,220 | 8/1950 | Lister | 91/65 |
| 2,570,806 | 10/1951 | Henry | 35/26 |
| 2,698,003 | 12/1954 | Bullock | 118/504 |
| 2,726,633 | 12/1955 | Miron | 118/504 |
| 3,220,374 | 11/1965 | Sloan | 115/5 |
| 3,583,357 | 6/1971 | Shimanokas | 115/41 |
| 4,276,852 | 7/1981 | Adams | 118/326 |
| 4,722,296 | 2/1988 | Bowskill et al. | 118/504 |

*Primary Examiner*—Joseph F. Peters, Jr.
*Assistant Examiner*—Kenneth Lee
*Attorney, Agent, or Firm*—Pennie & Edmonds

[57] ABSTRACT

A method and template to facilitate cleaning or painting of a gimbal housing which is mounted to a boat transom. This method comprises attaching a template to the transom around a gimbal housing perimeter which is intricately and arcuately shaped. The template is configured and dimensioned to correspond to the gimbal housing perimeter and to shield the transom from damage while cleaning or painting the gimbal housing. Thus, the amount of time required to clean and paint the gimbal housing and the amount of time required for clean-up is reduced by utilizing the method and template of the invention.

20 Claims, 4 Drawing Sheets

TEMPLATE FOR CLEANING OR PAINTING OF A GIMBAL HOUSING

BACKGROUND OF THE INVENTION

1. Field of the Invention

The present invention relates to motor boats, and, in particular, to a template that can be attached to a transom of a boat to facilitate cleaning or painting of a gimbal housing which is mounted to the transom.

2. Description of the Prior Art

Boats that are kept in the water for an extended period of time are subjected to a great deal of wear and tear due to the corrosive effects of the water and due to the growth of algae and barnacles on the submerged surfaces of the boat. Since this oxidation and marine growth must be removed to keep the boats in good condition, boat owners periodically remove their boats from the water to clean and repair them. During the course of this refurbishing, the gimbal housing is often cleaned and repainted after the outdrive has been removed therefrom. The cleaning of the gimbal housing usually comprises sandblasting or treating the housing with chemicals to remove rust, barnacles, or any other irregularities on the surface thereof.

However, when cleaning or repainting the gimbal housing, care must be taken to avoid damaging the transom of the boat. This damage is typically caused by splashing or spilling paint or other chemicals on the transom, or by accidentally sandblasting the transom along with the gimbal housing. In the past, to protect the transom from damage, boat mechanics spent a great deal of time and energy covering the transom near the gimbal housing with tape and/or paper or other masking materials. However, this covering process is inefficient, wasteful, and does not adequately protect the transom from paint overspray.

This process is inefficient and wasteful because it takes a great deal of time and energy to properly mask and cover the transom. The gimbal housing has an intricate shape that has a number of corners and straight and curved edges, and it is very difficult, if not impossible, to completely cover the transom along these edges with a single piece of tape. Thus, many small pieces of tape must be affixed to the transom along the curved edges of the gimbal housing to properly shield the transom. This is a very long, tedious process which requires the mechanic to spend a great deal of time and energy on a single boat. Thus, the number of boats the mechanic can work on in a single day is significantly reduced.

This process is still further inefficient and wasteful because clean-up takes a very long time. Each and every short piece of tape which had been attached to the transom must be removed, and this process takes even longer than it did to apply the tape to the transom. Thus, the amount of time spent by the mechanic on the gimbal housing is still further increased.

Finally, this process does not adequately protect the transom because the mechanic, in his haste to complete the job, often incompletely covers the transom. Further, since the mechanic is aware of the long clean-up time involved, he often tries to use a single piece of tape around the arcuate edges of the gimbal housing. Thus, only the immediately adjacent portion of the transom is protected. This process will leave many portions of the transom uncovered and will cause the transom to be cleaned and painted along with the gimbal housing. Since this causes a sloppy, unprofessional job that is unacceptable to the boat owner, the mechanic will have to spend even more time to clean and repair the transom after he has worked on the gimbal housing.

Accordingly, there is a need for a method and apparatus to efficiently and adequately shield a transom of a boat from damage when the gimbal housing is cleaned or painted so that the cleaning or painting of the gimbal housing is facilitated and the transom is protected.

SUMMARY OF THE INVENTION

In accordance with the present invention there is provided a method to facilitate cleaning and painting of a gimbal housing which is mounted to a boat transom. This method comprises attaching a template to the transom around a gimbal housing perimeter. The template is configured and dimensioned to correspond to the intricately and arcuately shaped gimbal housing perimeter and to shield the transom from damage when cleaning or painting the gimbal housing. The template itself is another embodiment of the invention. Thus, the amount of time required to clean and paint the gimbal housing and the amount of time required for clean-up is reduced when the novel template and method of the invention are utilized.

DETAILED DESCRIPTION OF THE PREFERRED EMBODIMENTS

Figure 1:
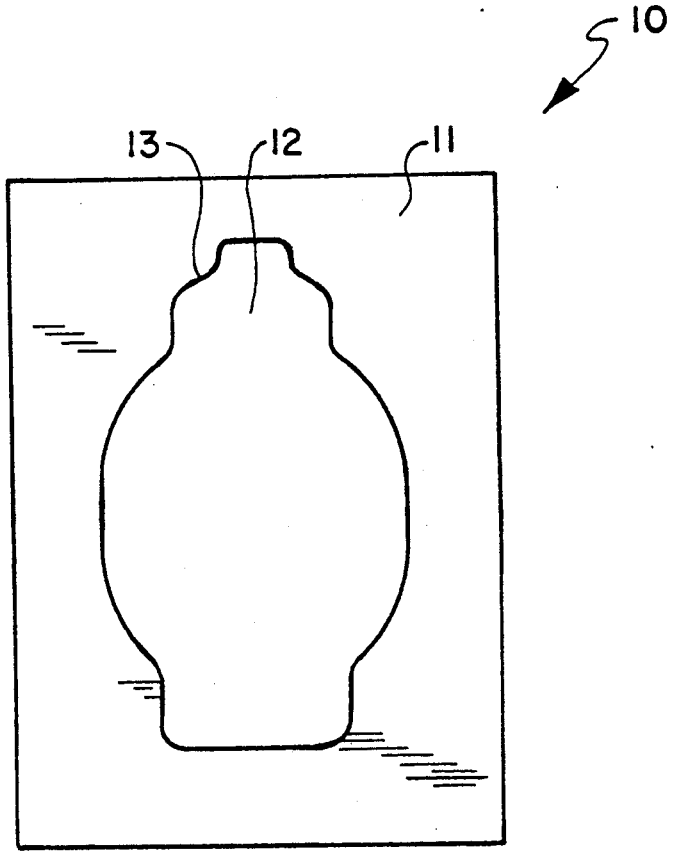
FIG. 1 is a plan view of an apparatus according to the invention which facilitates cleaning and painting of a gimbal housing of a stern drive engine.
Figure 2:
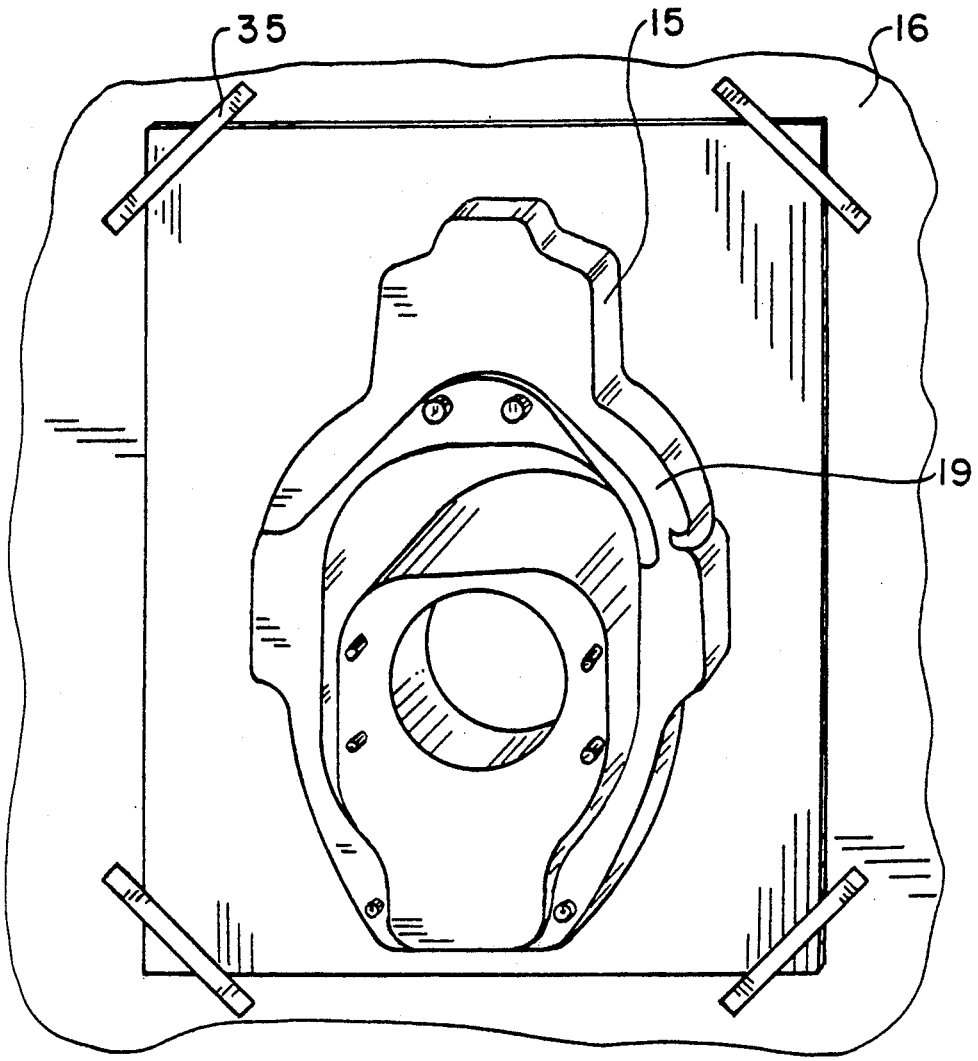
FIG. 2 is a perspective view of the apparatus attached to the transom of a boat around the gimbal housing.

Referring to the drawings and particularly to FIGS. 1 and 2, there is illustrated an apparatus 10 for shielding a transom of a boat from damage when a gimbal housing is cleaned and painted.

Apparatus 10, hereinafter referred to as template 11, comprises a cut-out portion 12 defined by an edge 13 and which is stamped from a sheet of flat, flexible material such as paper or flexible plastic. Cut-out portion 12 is configured and dimensioned to correspond to the intricate, arcuate shape of a gimbal housing 14. Gimbal housing 14 shown in FIG. 2 is the type of housing commonly used on Mercruiser Alpha drive units. However, the present invention contemplates the use of other templates configured and dimensioned to correspond to the intricate, arcuate shape of other types of gimbal housings that are used with other types of drive units, such as Mercruiser Bravo drive units, OMC Cobra drive units, and Volvo drive units (both old-style and new-style).

As shown in FIG. 2, gimbal housing 14 has a perimeter 15 that comprises a number of corners and straight and curved sections, and edge 13 conforms exactly and precisely to perimeter 15. Thus, template 11 may be affixed to a transom 16 of a boat by any known means, such as with an adhesive tape 35 so that edge 13 will be completely flush with perimeter 15 of gimbal housing 14. Also, the length and width of the template 11 provides a relatively large area of coverage over adjacent portions of the transom 16. Thus, transom 16 will be completely covered adjacent the perimeter of the gimbal housing 14 and will not be damaged when the gimbal housing is cleaned or painted. Further, since template 11 comprises only a single sheet of paper, the amount of time required to cover transom 16 with template 11, as well as the amount of time required to remove template 11 therefrom, is very short.

Most stern-drive boats have a plurality of items such as swimming platforms, speedometer cables, or power tilt units affixed to the transom thereof, however, and these items partially obstruct access to gimbal housing 14. Thus, a one-piece template 11 as provided above would be inconvenient to use and may not completely cover transom 16.

Figure 3:
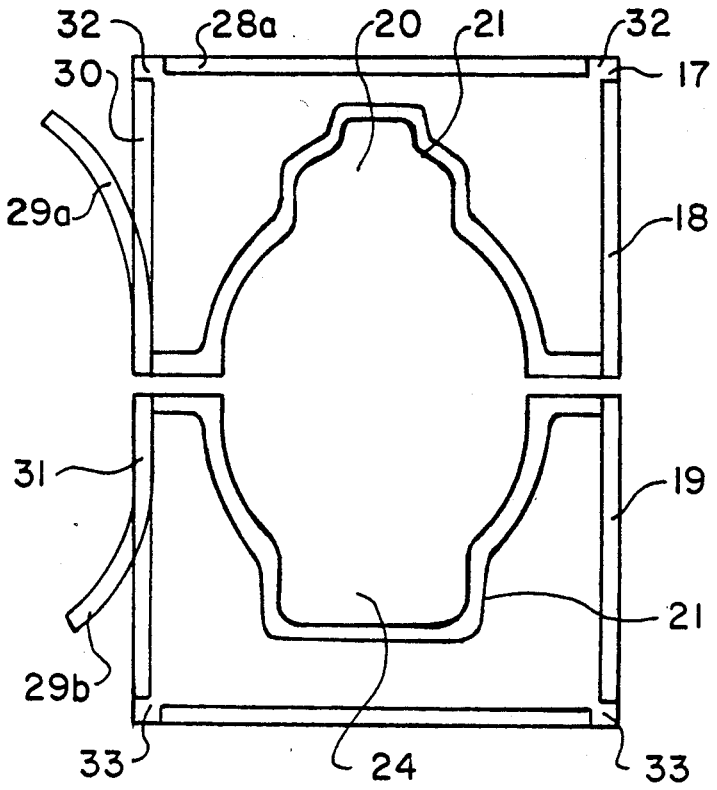
FIG. 3 is a rear view of a preferred embodiment of the apparatus of the present invention.
Figure 4:
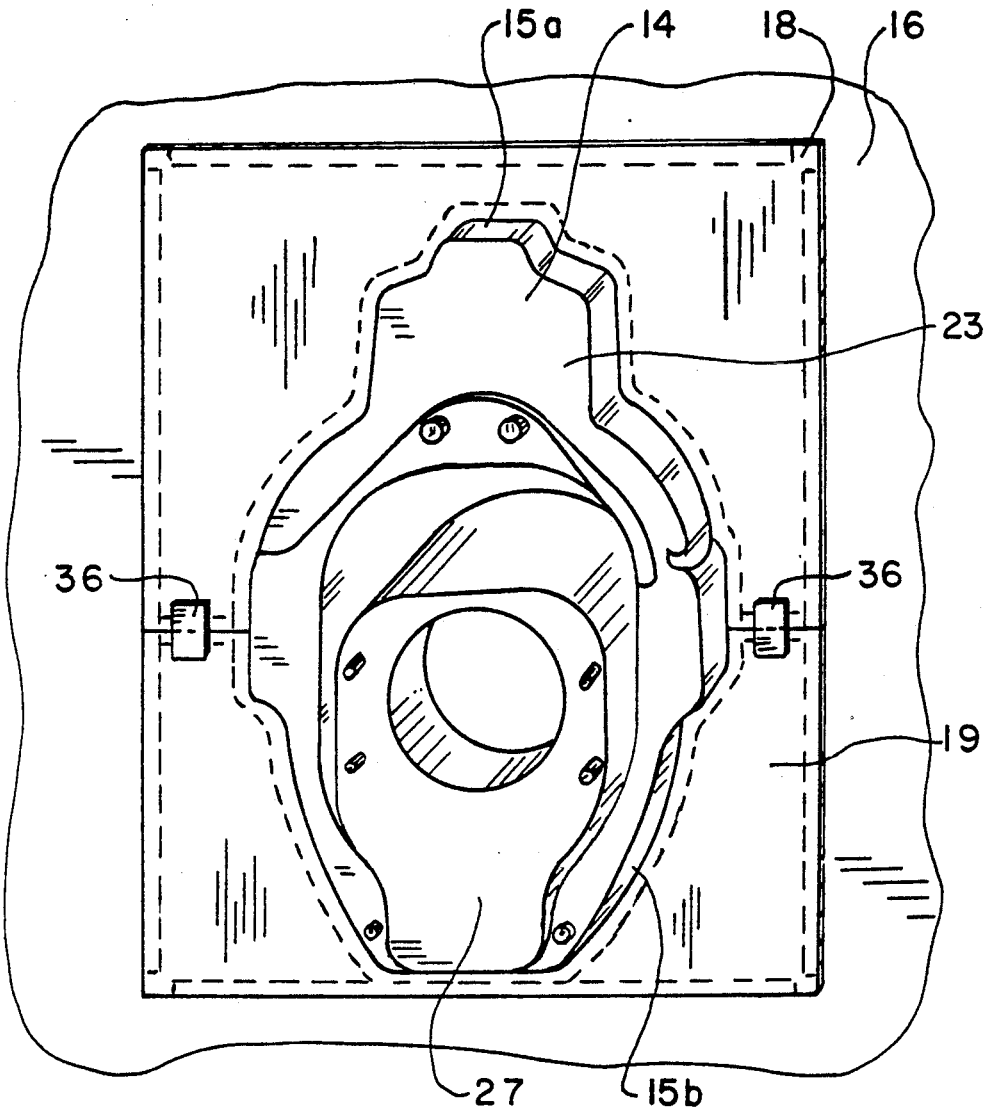
FIG. 4 is a perspective view of the apparatus of FIG. 3 attached to the transom of a boat around the gimbal housing.

Accordingly, a preferred embodiment of the present invention is illustrated in FIGS. 3 and 4. FIG. 3 shows a template 17 that is cut into two halves and comprises an upper portion 18 and a lower portion 19. Although template 17 of the present embodiment is illustrated with only two portions 17 and 18, it is contemplated that template 17 may comprise three, four, or any number of portions. The lesser number of portions are advantageous in that less time is needed to install and remove them.

Upper portion 18 comprises a cut-out portion 20 defined by an edge 21 that is configured and dimensioned to correspond to the intricate, arcuate shape of perimeter 15*a* of an upper portion 23 of gimbal housing 14. Likewise, lower portion 19 comprises a cut-out portion 24 defined by an edge 25 that is configured and dimensioned to correspond to the intricate, arcuate shape of perimeter 15*b* of a lower portion 27 of gimbal housing 14. Since edges 21, 25 conform exactly to perimeters 15*a*, 15*b*, upper portion 18 and lower portion 19 of template 17 may be secured to transom 16 and edges 21, 25 will be completely flush with perimeters 15*a*, 15*b*. If there are any items partially obstructing access to gimbal housing 14, upper and lower portions 18, 19 may be manipulated around and behind that item to shield transom 16.

In one embodiment, template 17 is made of paper or flexible plastic and is attached to the transom 16 using adhesive tape, as shown above in FIG. 1. In addition upper portion 18 is attached to lower portion 19 by adhesive tapes 36 placed on their abutting portions.

In another embodiment, template 17 preferably further comprises an adhesive 28*a*, 28*b* to secure template 17 to transom 16. The adhesive 28*a*, 28*b* is on surfaces 29*a*, 29*b*, respectively, of the template 17 of upper portion 18 and lower portion 19, respectively, that face transom 16. Although adhesive 28*a*, 28*b* along may completely cover surfaces 29*a*, 29*b*, respectively, it is advantageous to only apply adhesive 28*a*, 28*b* peripheral edges 30, 31, respectively, of upper portion 18 and lower portion 19, respectively. In this arrangement, it is preferred that corners 32, 33 of upper portion 18 and lower portion 19, respectively, do not have any adhesive thereon so that when it is desired to remove template 17 from transom 16, corners 32, 33 may be easily grasped to peel template 17 therefrom.

Preferably, adhesive 28*a*, 28*b* comprises polymeric or acrylate copolymer microspheres as disclosed in U.S. Pat. Nos. 3,691,140, 3,857,731 and 4,166,152, these are the same types of adhesive that are used on the 3M removable POST-IT TM brand note pads. Thus, template 17 is easily attachable to and removable from transom 16. However, if desired, adhesive 28*a*, 28*b* may comprise a material that provides a stronger bond for situations which require a stronger attachment of template 17 to transom 16.

Adhesive 28*a*, 28*b* may further be covered with a backing 29*a*, 29*b*, respectively, that is removed prior to securing template 17 to transom 16. Backing 29*a*, 29*b* preferably is a plastic film which is easily removable to expose the adhesive.

Preferably, a plurality of upper portions 18 and lower portions 19 are stacked, one on top of the other to form a pad upper portions 18 and lower portions 19 secured to other portions 18 and other lower portions 19 with adhesive layers 28*a*, 28*b*, respectively. Thus, when it is desired to use template 17, the mechanic must simply peel portions 18, 19 off the top of the pads and stick template 17 onto transom 16.

Thus, when template 17 is secured to transom 16, transom 16 will be covered and will not be affected when gimbal housing 14 is cleaned and painted. Further, since template 17 comprises only one or two sections, the amount of time required to cover transom 16 with template 17 and the amount of time required to remove template 17 therefrom is very short.

The present invention also provides a method to facilitate cleaning and painting of gimbal housing 11 which is mounted to boat transom 16, thereby reducing the amount of time required to clean and paint gimbal housing 11 and the amount of time required for clean-up. In this method, after the boat has been taken out of the water, the outdrive is removed, thereby exposing gimbal housing 14.

Template 11 or template 17 (with or without the adhesive backing) is then placed around the housing 14, secured to the transom, and the cleaning or painting operations may begin, the adhesive 28*a*, 28*b* of template 17 is then exposed, either by removing backings 29*a*, 29*a* respectively, or by peeling upper portion 18 and lower portion 19 off the pads. Upper portion 18 is then attached to transom 14 around perimeter 15*a* of gimbal housing 14 by adhesive 28*a* or tape 35.

Since cut-out portion 23 is configured and dimensioned to correspond to perimeter 15*a*, edge 21 of upper portion 18 will be completely flush against perimeter 15*a*. Likewise, lower portion 19 of template 17 is attached to transom 14 around perimeter 15*b* of gimbal housing 14 with adhesive layer 28*b*. Since cut-out 24 is configured and dimensioned to correspond to perimeter 15*b*, edge 25 of lower portion 19 will be completely flush against perimeter 15*b*. Thus, the entire portion of transom 16 near gimbal housing 14 will be completely covered by the template 16. Gimbal housing 14 may then be cleaned and painted without damaging transom 16.

Accordingly, by using template 17 in the method described above, transom 16 may be quickly, easily and completely shielded in the areas adjacent the gimbal housing 14 when it is desired to clean or paint the gimbal housing. Further, clean-up time will be reduced significantly, since the mechanic must simply peel template 17 off transom 16. It has been found that the time reduction is on the order of 30 to 40 minutes per housing. Thus, since the covering and clean-up time is significantly reduced, the mechanic will be able to attend to more boats and complete more jobs in a single day.

Further, since template 11 conforms exactly to the intricate shape of gimbal housing 14, there will be no gaps between template 11 and gimbal housing 17. This is achieved by making the template by die stamping.

First the gimbal housing of a particular manufacturer is removed from the boat, placed on paper, and its outline is traced to form a pattern. The pattern is then used to make a cutting die, which is used to cut templates 11 from the desired substrate. Templates 11, then may be cut in half to facilitate application to the housing in portions 18, 19. By making the template in this manner, a perfect match to the housing is assured. Thus, a professional cleaning and painting job may be consistently obtained and no additional time will have to be wasted to repair transom 16 after gimbal housing 14 is cleaned and painted.

Accordingly to the provisions of the Patent Statutes, I have explained the principle, preferred construction and mode of operation of my invention and have illustrated and described what I now consider to represent its best embodiments. However, it should be understood, that within the scope of the appended claims, the invention may be practiced otherwise than as specifically illustrated and described.

I claim:

1. A method for reducing the time for cleaning or painting of a gimbal housing which is mounted to a boat transom, which comprises attaching a template to the boat transom around an intricately and arcuate-shaped gimbal housing perimeter prior to cleaning or painting of the gimbal housing, wherein the template has at least two sections and is configured and dimensioned to correspond to the gimbal housing perimeter thus shielding the transom from damage with the template while the gimbal housing is cleaned or painted to facilitate the cleaning and painting of same while reducing the amount of time required to clean or paint the gimbal housing, wherein the template sections are sequentially attached to the transom.

2. The method of claim 1, wherein the template is attached to the transom with one or more adhesive strips.

3. The method of claim 1, wherein the template includes an adhesive on at least a portion of one side thereof and attaching that side of the template to the transom.

4. The method of claim 3, wherein the template has a peripheral edge and which further comprises providing the template with adhesive along the peripheral edge.

5. The method of claim 2, which further comprises retaining at least one corner of the template free of adhesive to facilitate removal of the template from the transom after the cleaning or painting of the gimbal housing.

6. The method of claim 1 which further comprises forming the template from a flat, flexible material with a cut out portion which conforms to the gimbal housing perimeter.

7. The method of claim 6 which further comprises making a pattern of the gimbal housing, forming a die from the pattern, and stamping the template from the flat, flexible material with the die.

8. The method of claim 7 which further comprises cutting the template into sections prior to applying the template sections to the transom.

9. An apparatus to facilitate cleaning or painting of a gimbal housing which is mounted to a transom of a boat and to shield the transom from damage during cleaning or painting, comprising:

a template having at least two sections forming a cut-out portion configured and dimensioned to correspond to the perimeter of an intricately and arcuately shaped gimbal housing, and a shielding portion configured and adapted to extend away from the perimeter of the gimbal housing;

whereby the transom surrounding the gimbal housing is shielded by the template, so that the gimbal housing may be quickly and easily cleaned or painted without damaging the transom.

10. The apparatus of claim 9, wherein the template comprises a plurality of separate sections of flat, flexible material to facilitate installation of the template around the perimeter of the gimbal housing.

11. The apparatus of claim 9, wherein the template is made of paper or a plastic material.

12. The apparatus of claim 9, which further comprises means for temporarily securing the template to the transom.

13. The apparatus of claim 12, wherein the securing means comprises an adhesive.

14. The apparatus of claim 13, wherein the template has a peripheral edge and the adhesive is present on the peripheral edge.

15. The apparatus of claim 13, wherein at least one corner of the peripheral edge of the template is free of adhesive to facilitate removal from the transom.

16. The apparatus of claim 13, wherein the adhesive is present on at least a portion of the surface of the template that faces the transom.

17. The apparatus of claim 13, wherein the adhesive is protected by a removable cover strip.

18. An apparatus to facilitate cleaning or painting of a gimbal housing which is mounted to a transom of a boat and to shield the transom from damage during the cleaning or painting, comprising:

a template having at least first and second sections, with the first section having a cut-out portion which is configured and dimensioned to correspond to a first portion of the perimeter of the gimbal housing, and the second section having a cut-out portion which is configured and dimensioned to correspond to a second portion of the perimeter of the gimbal housing, wherein the perimeter of the gimbal housing is intricately and arcuately shaped and the sections are configured and adapted to substantially surround the perimeter of the gimbal housing, each section also having a shielding portion configured adapted to extend away from the perimeter of the gimbal housing;

whereby the transom surrounding the gimbal housing will be completely shielded by the upper and lower portions of the template, so that the gimbal housing may be quickly and easily cleaned or painted without damaging the transom.

19. The apparatus of claim 18, wherein the template comprises a flat, flexible material and which further comprises means for temporarily securing the template to the transom.

20. The apparatus of claim 19, wherein the securing means is an adhesive which is placed on at least a portion of a surface of the template that faces the transom.

* * * * *